United States Patent [19]

Peva, Jr.

[11] 3,968,901

[45] July 13, 1976

[54] STRAW DISPENSER

[75] Inventor: Stanley W. Peva, Jr., Salem, N.H.

[73] Assignee: Austin-Gordon Design, Inc., Nashua, N.H.

[22] Filed: Feb. 14, 1975

[21] Appl. No.: 549,880

[52] U.S. Cl. ..... 221/93; 221/236; 221/266; 198/62; 53/236

[51] Int. Cl.[2] ..... B65H 3/44

[58] Field of Search ..... 221/93, 94, 95, 205, 221/155, 233, 235–237, 258, 262–266, 270, 272, 274, 276, 277, 296, 297, 123, 239; 198/26, 62; 53/236

[56] References Cited

UNITED STATES PATENTS

| | | | |
|---|---|---|---|
| 639,383 | 12/1899 | Harris | 221/93 |
| 857,427 | 6/1907 | Waldron | 198/26 |
| 1,132,638 | 3/1915 | Tripp | 221/272 |
| 1,616,453 | 2/1927 | Knable | 221/236 |
| 2,551,424 | 5/1951 | Donald | 221/155 |
| 3,737,072 | 6/1973 | Deitrick | 221/277 |

*Primary Examiner*—Robert B. Reeves
*Assistant Examiner*—H. Grant Skaggs
*Attorney, Agent, or Firm*—Cesari and McKenna

[57] ABSTRACT

An improved straw dispenser dispenses a plurality of straws simultaneously into the open tops of a corresponding number of beverage containers in a container making machine. The dispenser has a plurality of dispensing stations, each containing a rotary index wheel which picks up a succession of straws from a hopper and delivers them one after another into a separate chute which guides the straws into a separate delivery tube positioned directly above a beverage container. The index wheels at all of the stations index in response to a signal from the container making machine in synchronism to drop a set of straws into those tubes. Gates at the lower ends of the tubes open simultaneously and drop the set of straws then in the tubes into containers positioned below them before the new set of straws reaches the tubes.

12 Claims, 5 Drawing Figures

STRAW DISPENSER

BACKGROUND OF THE INVENTION

This invention relates to an improved straw dispenser. It relates more particularly to a straw dispenser which is arranged to drop straws into the open tops of beverage containers. The dispenser is particularly suited for use in conjunction with a machine of the type described in U.S. Pat. No. 3,144,976 which makes beverage pouches having a beverage compartment and a separate straw compartment. A straw is dropped into the straw compartment, following which the beverage compartment is filled and both compartments are then sealed, making a self-contained beverage pouch with straw.

Conventionally, straw dispensers used for this purpose dispense straws one at a time into a succession of single beverage pouches. Recently, however, to increase production, a container-making machine has been designed which forms, fills and seals a succession of pouch sets, with each set consisting of several pouches arranged close together side-by-side.

It has been proposed to use several prior straw dispensers together in order to deposit the requisite number of straws into each set of pouches. In practice, however, this has not proved feasible because the dispensers themselves are relatively bulky and it has proven quite difficult to reliably conduct straws simultaneously into each set of pouches as each set is advanced through the straw dispensing station. Sometimes a straw, particularly one which is irregular or bent, becomes jammed and does not reach its destination at the proper time. This can result in one or another of the pouches being filled and sealed without a straw. If the jam persists, the straw dispenser and, therefore, the entire container production line must be shut down until the problem is corrected.

This problem is exacerbated in many prior machines because the locations at which straws are most likely to become jammed are not readily accessible so that it takes a relatively long time to remove the offending straws. Other conventional machines of this general type are overly complex, making them unduly expensive to make and maintain.

SUMMARY OF THE INVENTION

Accordingly, the present invention aims to provide a straw dispenser which is quite compact yet is able to dispense a plurality of straws simultaneously to a set of beverage containers.

A further object of the invention is to provide a straw dispenser which reliably and accurately conducts the straws to their destinations so that there is little likelihood of a beverage container being filled and sealed without a straw.

A further object of the invention is to provide a straw dispenser which is not prone to jamming because of bent or misshapen straws.

Yet another object of the invention is to provide a straw dispenser which is relatively uncomplicated and easy to maintain.

Other objects will in part be obvious and will in part appear hereinafter.

The invention accordingly comprises the features of construction, combination of elements, and arrangement of parts which will be exemplified in the following detailed description, and the scope of the invention will be indicated in the claims.

In general, the present straw dispenser comprises a plurality of dispensing stations which draw straws from a common hopper. Each station has an index wheel positioned at the bottom of the hopper and all of the wheels are indexed in unison in response to a DISPENSE signal from the container-making machine indicating that a set of beverage pouches is positioned at the straw dispensing station of the machine. Each index wheel is notched all around its periphery, each notch being slightly larger than the diameter of a straw so that straws from the hopper tend to occupy the uppermost notches on each index wheel.

A guide plate is associated with each index wheel. Each guide plate conforms to the corresponding index wheel, extending from a point directly above that index wheel to a point directly below that wheel. Each time an index wheel is indexed, the wheel rotates enough to bring the uppermost notch containing a straw opposite the associated guide plate so that the straw is trapped between the notch at the plate. At the same time, the index wheel notch (and straw therein) which is closest to the lower edge of the guide plate is moved beyond the guide plate so that the straw therein is free to fall out of the notch. Thus, once the index wheel has been indexed around so that all of the notches opposite the guide plate are occupied by straws, each time the wheel is indexed, one straw drops away from the bottom of the index wheel while a new straw is taken in at the top thereof from the hopper.

An inclined chute is positioned directly below each index wheel and is oriented so that the straws which drop from that wheel enter the chute and slide down into the flared upper end of a vertically oriented dispensing tube. The inside diameter of the tube is slightly larger than the diameter of the straw and its lower end is positioned directly above the dispensing station of the container-making machine and the beverage pouch which is to receive that straw.

A normally closed gate is located at the bottom of each dispensing tube and all of the gates are opened momentarily in unison by the DISPENSE signal from the container-making machine. Upon the occurence of each such signal, the set of straws then in the dispensing tube are deposited into the set of pouches in the dispensing station directly below them. At the same time, the index wheels are indexed so that another set of straws is dropped into the chutes. By the time the new set of straws reach the dispensing tubes, the gates have closed. Consequently, the new set of straws is retained at the lower ends of those tubes until receipt of the next DISPENSE signal from the container-making machine indicating that a new set of pouches has moved into position to receive straws.

If a bent or misshapen straw is drawn from the hopper by an index wheel, it might become stuck in the wheel notch and not drop away from the wheel into the associated chute as it is supposed to. To avoid this potential problem, each dispensing station has a stripper plate positioned adjacent the index wheel in the path of the straw contained in the lower-most notch of the wheel. If the straw does not freely drop out of the notch, it is engaged by the stripper plate and forcibly pushed out of the notch and falls into its chute.

The only locations in the apparatus aside from the index wheels where straws are likely to become stuck are in the dispensing tubes and chutes. As will be described later, provision is made for giving the operator ready access to these parts so that any obstructions therein can be removed as quickly as possible.

The present straw dispenser can serve a larger number of beverage containers than prior comparable dispensers of this type. Furthermore, the apparatus is quite accurate and reliable so that the chances of straws not being deposited in their containers at the proper time are minimized. Consequently, the dispenser illustrated herein should contribute to increased production and efficiency and reduced labor costs.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
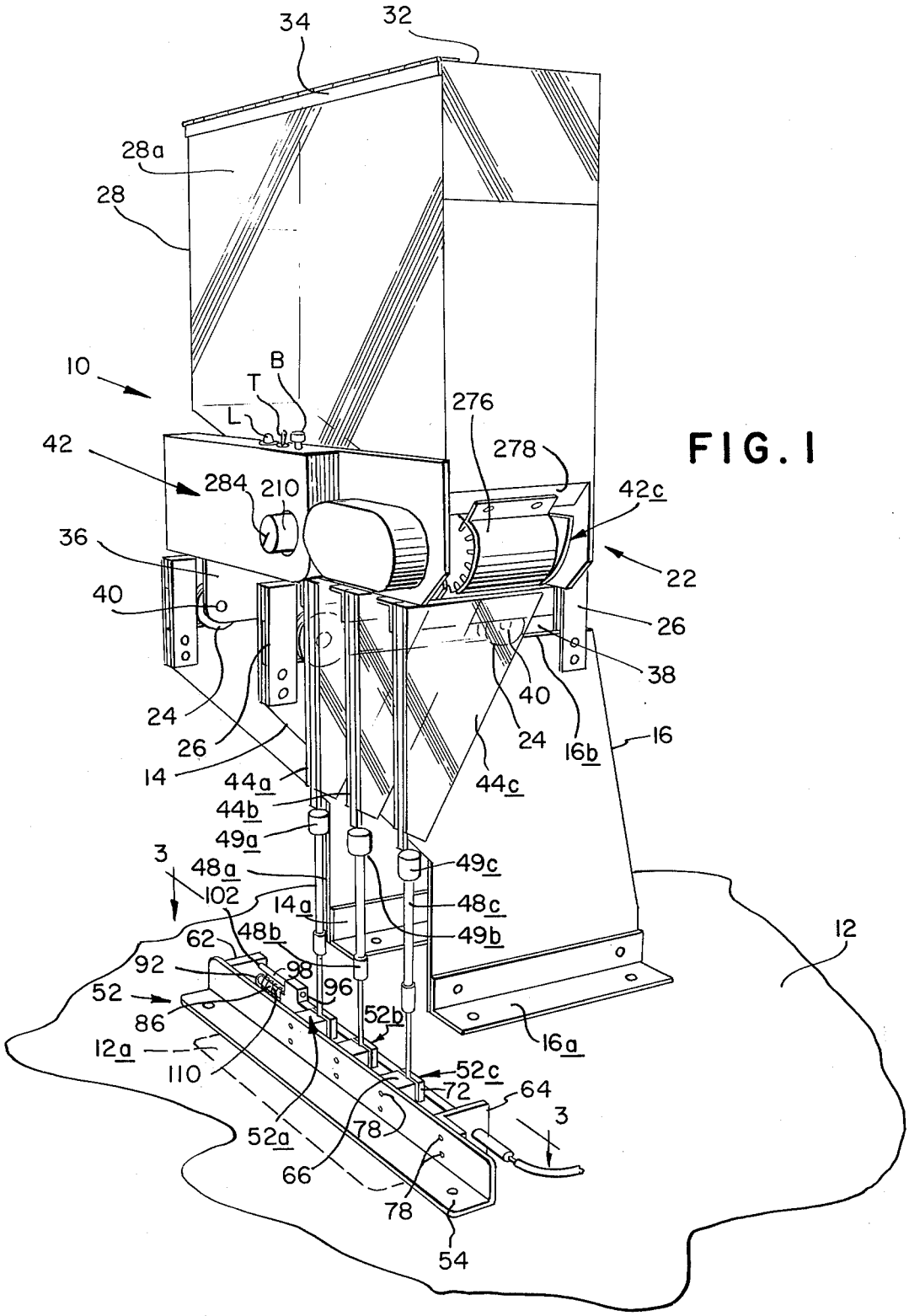
FIG. 1 is a perspective view showing a straw dispenser made in accordance with this invention mounted on a conventional container-making and filling machine.

Referring now to FIG. 1 of the drawings, the straw dispenser shown generally at 10 is used in conjunction with a conventional container making and filling machine indicated at 12. The dispenser is supported on machine 12 by a pair of upstanding legs 14 and 16 whose flanged lower ends 14*a* and 16*a* are bolted to the top of machine 12. Preferably, the container-making machine is of the type which advances successive sets of open-topped beverage pouches into a dispensing station 12*a* located directly below dispenser 10. The dispenser deposits straws into the straw compartments of these pouches, following which the set of pouches is advanced out of the dispensing station to be replaced by a new set. After the straws are placed in the beverage pouches, the beverage compartments of these pouches are filled with a liquid refreshment, following which the pouches are sealed and packed for shipment.

Figure 2:
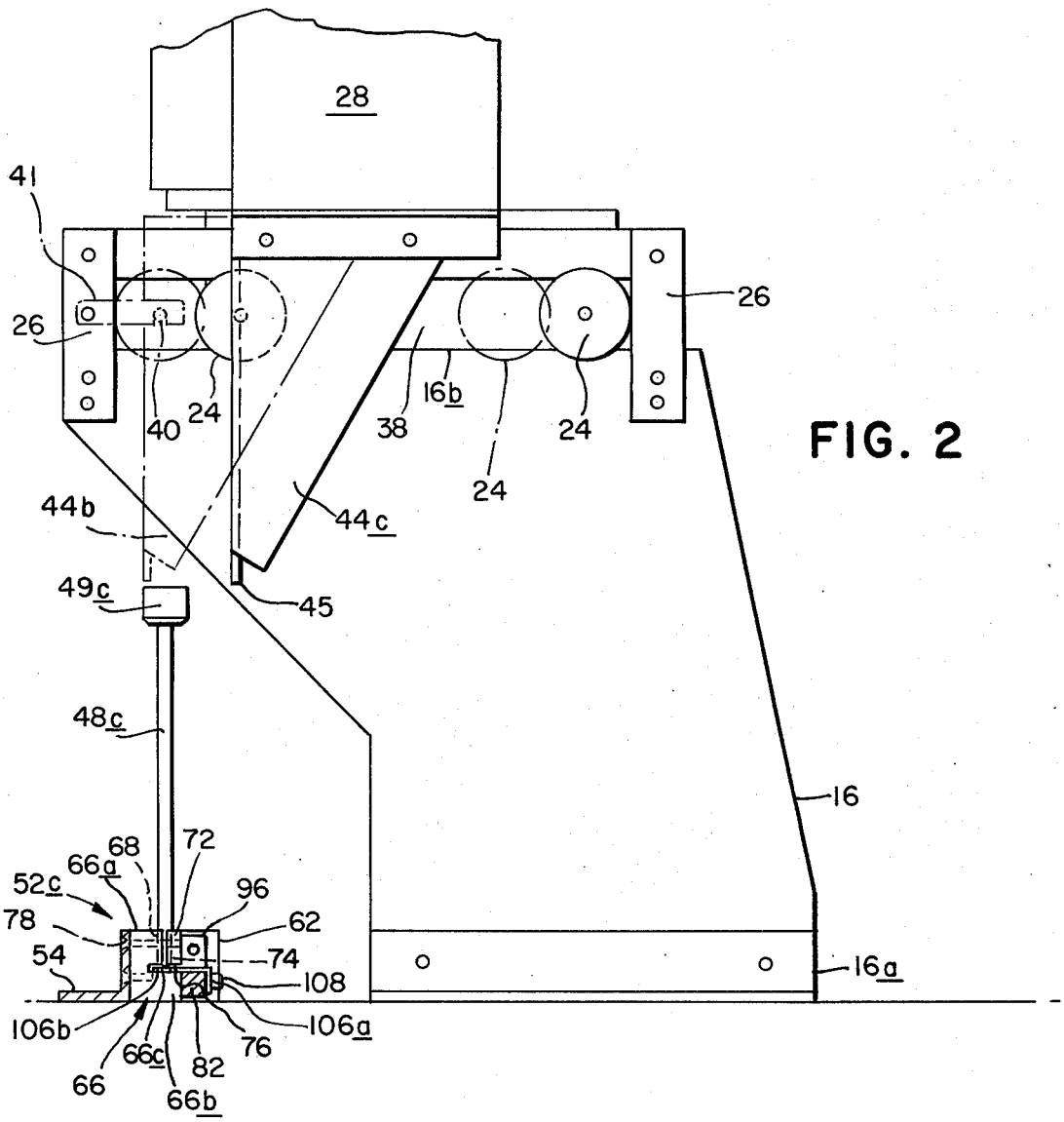
FIG. 2 is a view in side elevation of a portion of FIG. 1 dispenser further illustrating its operation.

As best seen in FIGS. 1 and 2, the dispenser includes an upper section indicated generally at 22 which contains the major components of the apparatus. Pairs of spaced-apart parallel wheels 24 at the bottom of section 22 ride on the upper horizontal edges 14*b* and 16*b* of legs 14 and 16 which edges function as tracks for the wheels. The wheels are retained on their respective tracks by cages 26 secured to the tops of the legs.

Section 22 comprises a generally rectangular hopper 28 for containing a supply of straws. The front wall 28*a* of the hopper is transparent so the quantity of straws in the hopper at any given time can readily be ascertained. The top of the hopper is closed by a cover 32 which is connected to the front wall 28*a* by a hinge 34.

A pair of spaced parallel plates 36 and 38 extend down from the hopper toward legs 14 and 16 and the wheels 24 are rotatively connected by bolts 40 to the opposite ends of these plates near the lower edges thereof. The dispenser section 22 can thus be rolled on legs 14 and 16 between a forward position shown in FIG. 1 and in dotted lines in FIG. 2 to a rearward position shown in solid lines in FIG. 2 to some extent relative to legs 14 and 16 for reasons to be described later. During normal use of the machine, section 22 is located in the forwardmost position shown in FIG. 1 and is retained there by a suitable latch such as the one indicated at 41 in FIG. 2. Latch 41 is pivoted to cage 26 and engages over the wheel axle 40.

Still referring to FIG. 1, an indexing system indicating generally at 42 is positioned at the bottom of hopper 28. The illustrated system has three sections 42*a* to 42*c* (FIGS. 4 and 5), enabling it to dispense three straws at the same time into a set of three pouches positioned at the dispensing station 12*a* of machine 12. More particularly, sections 42*a*, 42*b*, and 42*c* take on three straws from the bottom of hopper 28 and deposit them in separate chutes 44*a*, 44*b* and 44*c*. The straws slide down the chutes into three separate vertically oriented dispensing tubes 48*a*, 48*b* and 48*c*. Each chute has a tongue 45 (FIG. 2) projecting from its lower end just ahead of the top of the corresponding tube to ensure that the descending straw does not overshoot the tube. Also the upper ends 49*a* to 49*c* of these tubes are flared to facilitate entry of the straws. A gate assembly indicated generally at 52 is positioned at the lower ends of these tubes. The assembly includes a horizontal bracket 54 which is suitably secured to the top of the container-making machine 12 so that the tubes 48*a* to 48*c* are positioned directly below the lower ends of the chutes 44*a*, 44*b* and 44*c* and directly above dispensing station 12*a*.

The gate assembly 52 has three gate sections 52*a* to 52*c* which normally close the lower ends of tubes 48*a* to 48*c* so that the straws that are dropped into the tubes are retained there until the gate sections open.

Each time the container-making machine 12 advances a set of containers into the dispensing station 12*a*, it applies an electrical DISPENSE signal to assembly 52. In response to this signal gate sections 51*a* to 52*c* open momentarily allowing the three straws to drop from tubes 48*a* to 48*c* into the pouches at station 12*a* directly below them. The same signal is applied to indexing system 42 causing it to deposit another set of three straws into chutes 44*a* to 44*c*. By the time those three straws reach the dispensing tubes 48*a* to 48*c*, the gate sections 52*a* to 52*c* will have closed. Resultantly the new set of straws is retained in the dispensing tubes to await the next DISPENSE signal from machine 12.

In the event that a bent or mutilated straw becomes lodged in one of chutes 44*a–44c* or tubes 48*a–48c*, latch 40 can be released and the entire dispenser section 22 rolled back on the legs 14 and 16, to its solid line position in FIG. 2. This completely exposes the upper ends of the dispensing tubes as indicated there so that the blockage can be removed in the most expeditious manner.

Figure 3:
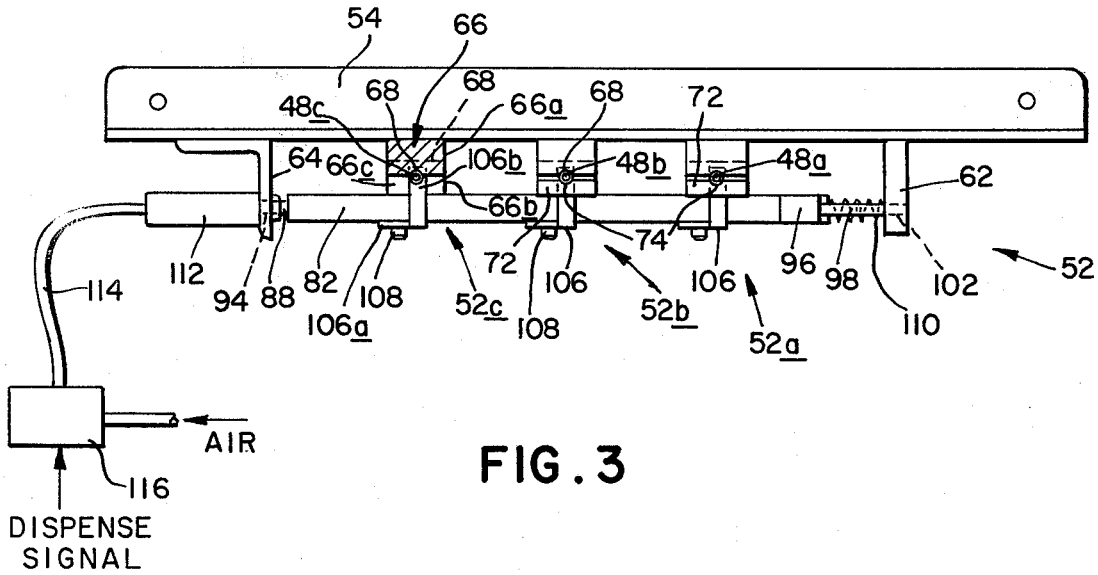
FIG. 3 is a view along line 3—3 in FIG. 1 detailing another part of the apparatus.

Referring now to FIGS. 1, 2 and 3, gate assembly 52 includes a pair of spaced parallel end plates 62 and 64 secured to the opposite ends of bracket 54. The three assembly sections 52*a* to 52*c* are distributed evenly along the space between these two plates and are appropriately secured to bracket 54. Sections 52*a* to 52*c* are identical. Therefore, we will describe only section 52*c* in detail. It comprises a generally L-shaped block 66 whose long leg 66*a* is secured to bracket 54 and whose short leg 66*b* extends rearwardly at right angles to bracket 54, forming a horizontal surface 66*c*. A semicircular channel 68 is formed in leg 66*a* which extends from the top of that leg down to surface 66*c*.

A rectangular block 72 which is slightly shorter than leg 66*a* is arranged to be clamped to leg 56*a*. This block also has a semicircular channel 74 which is positioned directly opposite channel 68 in leg 66*a*. Block 72 is positioned on leg 56*a* so that its lower end is slightly above surface 66*c*, thereby leaving a slot 76 (FIG. 2) between the lower end of the block and surface 66*c*. The delivery tube 48*c*, is inserted into the channels from above and the block 72 is clamped to leg 66*a* by any suitable means illustrated by bolt 78 (FIGS. 1 and 2).

Gate assembly sections 52*a* and 52*b* are identical to section 52*c* and support their respective tubes 48*a* and 48*b* in the very same way.

Still referring to FIGS. 1, 2 and 3, a straight bar 82 having a rectangular cross section is slidably supported between plates 62 and 64. More particularly, the bar has a pair of cylindrical rods 86 (FIG. 1) and 88 projecting from its opposite ends through a pair of openings 92 (FIG. 1) and 94 in plates 62 and 64, respectively. Also, as best seen in FIGS. 2 and 3, to prevent bar 82 from turning about its longitudinal axis, a raised pedestal 96 is provided at one end which supports a horizontal rod 98 that projects through an opening 102 in plate 62. To minimize sliding friction as between the rods 86 and 98 on the one hand and plate 62 on the other, the plate is desirably made of a low-coefficient-of-friction material such as a waxy plastic.

As best seen in FIG. 3, bar 82 supports three identical straps 106, there being one strap at each section 52*a* to 52*c*. Each strap 106 has two legs 106*a* and 106*b* arranged at right angles to one another. When the strap is properly positioned at its station and bar 82 is in its leftmost position as shown in FIG. 3, strap leg 106*a* lies flush against the side of bar 82, while strap leg 106*b* projects into the associated slot 76 and thus effectively blocks the bottom of the associated delivery tube 48. The strap is held in this position by a screw 108 which passes through leg 106*a* and is threaded into bar 82.

Bar 82 is normally maintained in this leftmost position by a coil spring 110 encircling rod 86 and compressed between the end of bar 82 and plate 62. Thus, normally, assembly 52 and, more specifically, the three straps 106 block the bottom of the three delivery tubes 48*a* to 48*c* and prevent the straws delivered to those tubes from dropping through assembly 52 to the work station 12*a* (FIG. 1).

The rod 88 projecting from bar 82 is connected to the piston rod of a conventional air cylinder 112 secured to plate 64. Air cylinder 112 receives air pulses via a conduit 114 from a conventional solenoid valve 116 connected to a suitable source of compressed air. Valve 116 opens momentarily upon receipt of a DISPENSE signal from container-making machine 12 (FIG. 1) as each set of beverage pouches is advanced into dispensing station 12*a*. The pulse of air is of sufficient strength and duration to cause cylinder 112 to shift bar 82 so that the strap arms 106*b* are moved laterally in slots 76 beyond tubes 48*a* to 48*c* so that straws in those tubes are free to drop through assembly 52 into the dispensing station 12*a*. As soon as cylinder 112 is vented spring 110 shifts rod 82 back to its original position so that the strap legs 106*b* again block tubes 48*a* to 48*c* before the new set of straws sliding down chutes 44*a* to 44*c* reach the bottoms of the tubes.

Figure 4:
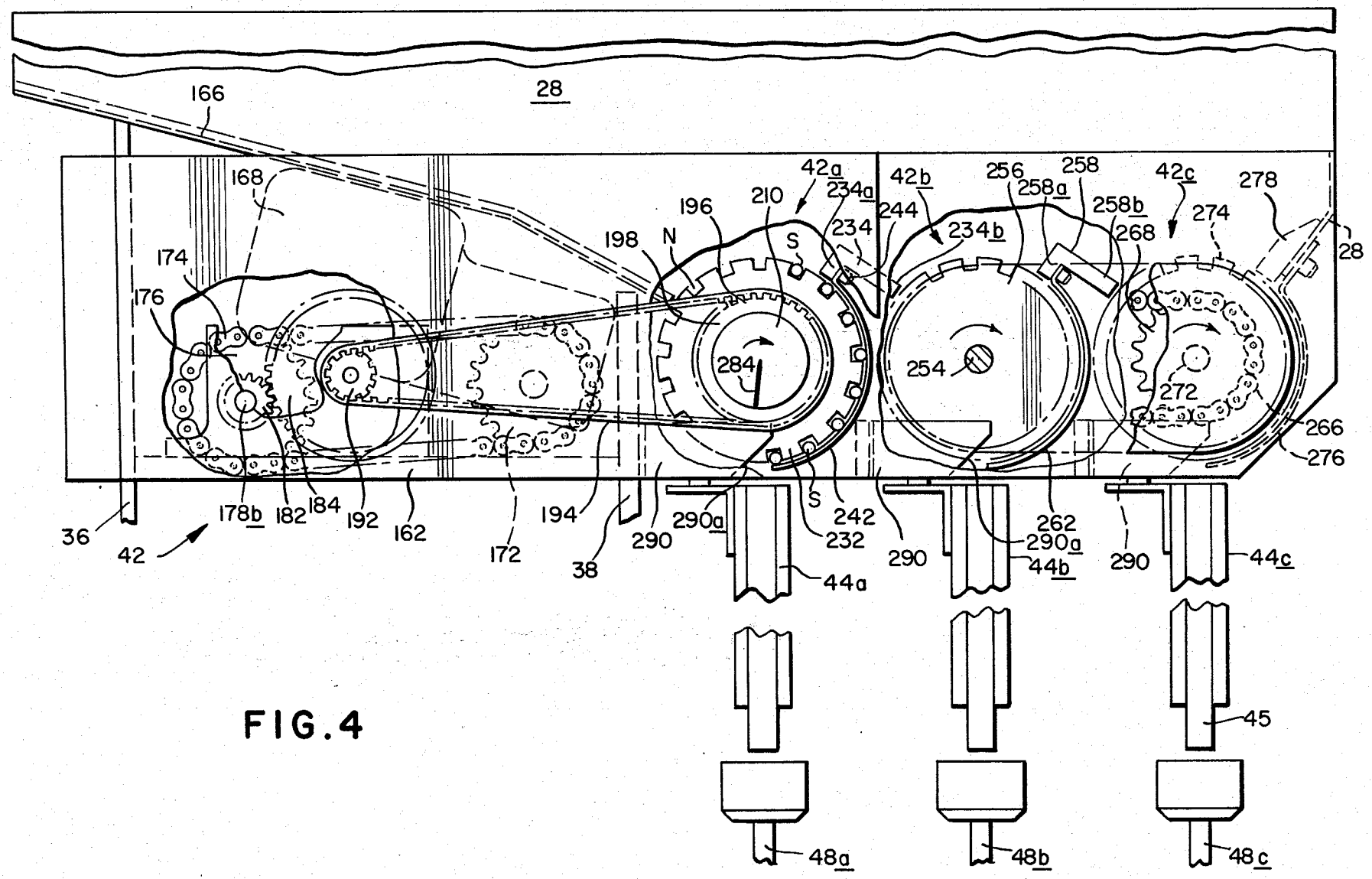
FIG. 4 is a view in side elevation on a larger scale showing still another portion of the FIG. 1 dispenser.
Figure 5:
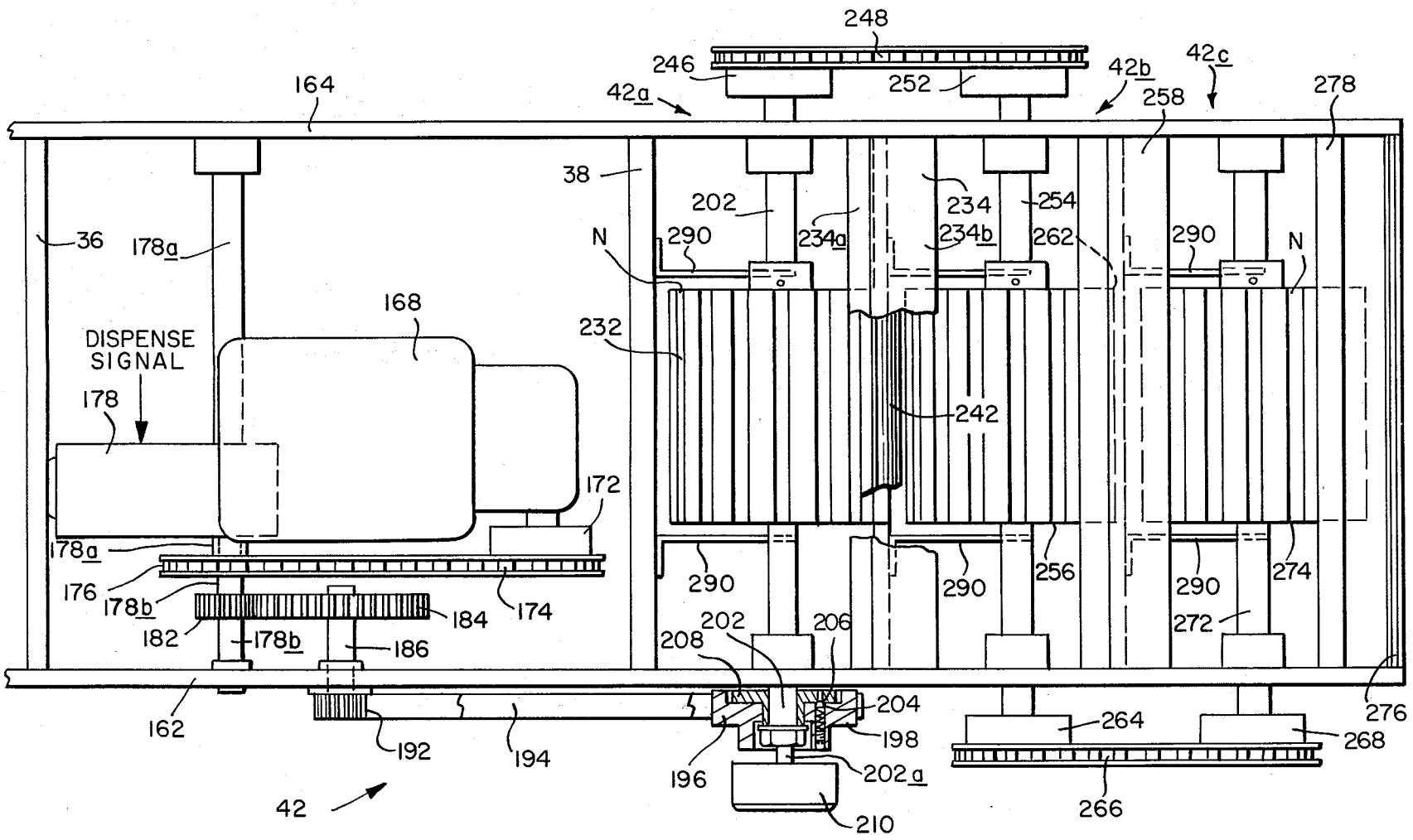
FIG. 5 is a top plan view thereof.

Referring now to FIGS. 4 and 5, indexing assembly 42 delivers straws from hopper 28 to the three chutes 44*a* to 44*c* at the proper time upon receipt of a DISPENSE signal from machine 12 as described previously. Assembly 42 includes spaced-apart parallel plates 162 and 164 secured to plates 36 and 38 and to the front and rear walls of hopper 28. The bottom of hopper 28 is open, except for an inclined wall 166 which extends from the left side of hopper 28 as viewed in FIG. 4 to a line just beyond plate 38.

Suspended from plate 166 is a gear motor 168 having on the order of 1/50 horsepower and a 15:1 gear reduction ratio. Motor 168 drives a sprocket 172. A chain loop 174 is trained between sprocket 172 and a second sprocket 176 which drives a conventional one-half revolution electric clutch 178 (FIG. 5). Clutch 178 has coaxial input and output shafts 178*a* and 178*b*. The sprocket 176 is connected to one end of the input shaft 178*a*, the other end of the shaft being journaled in plate 164. When the clutch is energized a solenoid therein momentarily engages the input and output shafts so that the output shaft makes one-half a revolution.

The clutch output shaft 178*b*, is journaled in plate 162 and carries a relatively small diameter spur gear 182. Gear 182 meshes with a much larger diameter spur gear 184 mounted at one end of a stub shaft 186 journaled in plate 162. The stub shaft 186 extends through plate 162 and carries a toothed pulley 192. A timing belt 194 is trained around pulley 192 and also around a somewhat larger diameter toothed pulley 196 which constitutes the input element of a conventional manual override clutch 198. The output shaft 202 of clutch 198 is journaled in plates 162 and 164 and torque is transmitted from pulley 196 to shaft 202 by means of a spring-loaded ball 204 in pulley 196 which is normally urged into locking engagement with a detent 206 in a collet 208. Collet 208 is fixed to rotate with output shaft 202 but is rotatable with respect to pulley 196.

When timing belt 194 turns pulley 196, the engagement between the spring-loaded ball 204 and detent 206 is sufficient to transmit the torque to the output shaft 202. However, the output shaft 202 can also be rotated manually by turning an external knob 210 connected to an extension 202*a* of output shaft 202. When the knob is turned with sufficient force, the spring-loaded ball 204 will ride up out of detent 206, permitting the collet 208 to rotate relative to gear 196. The same thing occurs if output shaft is prevented from turning because the index wheels become jammed. Consequently the motor 168 is protected from excessive stress that could damage it.

Still referring to FIGS. 4 and 5, rotation of the clutch output shaft 202 drives the three indexing assembly sections 42*a* to 42*c* in unison. The assembly sections are more or less the same. That is, section 42*a* includes an index wheel 232 in the form of a cylindrical drum fixed to rotate with shaft 202. As best seen in FIG. 4, the lower edge of plate 166 constituting the bottom wall of hopper 28 terminates just short of index wheel 232. An L-shaped channel 234 extends transversely between plates 162 and 164 on the opposite side of the wheel 232 axis so that channel 234 and plate 166 define between them an arc on wheel 232 of approximately 80°. Channel 234 is positioned so that its short leg 234*a* points toward the wheel 232 axis.

An arcuate plate 242 whose radius is slightly larger than that of wheel 232 is secured by one or more screws 244 to the channel leg 234*a*. Plate 242 conforms to the curvature of wheel 232 and extends from channel 234 to a line substantially directly below the wheel axis and directly above chute 44*a*.

Shaft 202 extends beyond plate 164 and carries a sprocket 246. A chain loop 248 connects sprocket 246 to a second sprocket 252 in assembly section 42*b*. Sprocket 252 is connected to a shaft 254 also journaled in plates 162 and 164. Shaft 254 supports a second index wheel 256 which is identical to wheel 232. The long leg 234*b* of channel 234 terminates just short of wheel 256. Also, a second channel 258 is suspended between plates 162 and 164 on the opposite side of drum 256 and defines with leg 234*b* an arc of about 80° around wheel 256. Assembly section 42*b* also includes a guide plate 262 which is identical to plate 242 and is connected in the same way to the short leg 258*b* of channel 258.

Shaft 254 extends beyond plate 162 and terminates in a sprocket 264 connected by chain loop 266 to a second sprocket 268. Sprocket 268 is connected to a shaft 272 journaled in plates 162 and 164 which drives the third assembly section 42*c*. An index wheel 274 rotates with shaft 272 and a guide plate 276 which is identical to the other two guide plates 242 and 262 is suspended from a bar 278 connected to the bottom of hopper 28 as best seen in FIGS. 1 and 4. Bar 278 defines, along with the channel leg 258*b*, the same 80° arc around the wheel 274.

Each index wheel 232, 256 and 274 has a series of spaced parallel slots or notches N distributed around its circumference. In a typical embodiment of this invention, there is a notch N approximately every 20° of arc around each wheel. Each notch is slightly wider and deeper than the outside diameter of a straw S. Also, the various gear ratios between clutch 178 and shaft 202 are arranged so that each actuation of clutch 178 causes the index wheels to rotate through 20° of arc, i.e. one slot position.

As shown in FIG. 5, clutch 178 is actuated by a DISPENSE signal from container-making machine 12 (FIG. 1). It can also be actuated to advance the wheels one slot position by depressing a front panel control button B at the front of assembly 42 as shown in FIG. 1. Other front panel controls include an on-off power switch T and a pilot light L. Also as noted previously, when the index wheels are turning, this fact is indicated by the motion of a bench mark 284 on knob 210. As shown in FIG. 1 desirably suitable covers are provided to enclose the various belts and chains to protect personnel in the area.

Normally, when a mass of straws S are properly loaded into hopper 28, they are aligned parallel to the axis of the index wheels. Furthermore, one or another of the straws at the bottom of the hopper in the vicinity of the exposed portions of the index wheels tend to fall into one or another of the slots N in those areas. As seen in FIG. 4, there are at least four exposed slots N in each assembly section 42 at any given time. Therefore, as the wheels are indexed in a clockwise direction, one or another of the straws in hopper 28 will fall into any empty exposed slot before that slot is advanced under its corresponding channel and guide plate.

Once a straw has dropped into a slot N, as soon as that slot is indexed around so that it is opposite the corresponding guide plate 242, 262, or 276, the straw becomes trapped in the channel until the wheel is further indexed to advance that slot beyond the lower edge of the guide plate. At that point, the straw in that slot is no longer trapped there by the guide plate and is free to drop out of the slot into the associated chute 44.

When starting the machine initially, the hopper 28 is filled with straws. Then the operator repeatedly depresses the switch B to cycle the machine until straws occupy all of the slots N in the index wheels that are exposed to the straws in the hopper or are positioned opposite the guide plates. Thus, upon the next actuation of the machine, the leftmost exposed slot in each wheel as viewed in FIG. 4 will take in a straw from hopper 10. At the same time, a straw will drop out of the lowermost slot in each wheel as it advances beyond the lower edge of the associated guide plate.

Alternatively the index wheels can be advanced manually using knob 210.

At this point, control of the dispenser is assumed by the container-making machine. As noted previously, each DISPENSE signal from the machine 12 releases the straws then in the delivery tubes 48*a* to 48*c* while a new set of straws drops from the lowermost slots in index wheels into their associated chutes 44*a* to 44*c*.

In some cases, the straws that occupy one or another of the slots N in the index wheels are sufficiently deformed or bent that they engage the sides of the slot and do not drop out of the slot when they should. To overcome this problem, a pair of stripper plates 290 are provided at each assembly section beyond the ends of the associated index wheel as shown in FIGS. 4 and 5. Each stripper plate is positioned near the bottom edge of the corresponding index wheel and its front edge 290*a* is shaped so that the plate presents an acute angle to the slot (and straw) being advanced beyond the lower edge of the corresponding guide plate. If a straw should become lodged in the slot, the plate will engage the ends of the straw projecting beyond the ends of the index wheel and wedge the straw out of the slot so that it drops into the associated chute 44 at the appropriate time. This helps to assure that each assembly section 42 will deliver its straw at the appropriate time so that none of the containers being advanced through machine 12 will fail to receive a straw before they are filled and sealed. Stripper plates 290 are held in position by appropriate channels (not shown) suspended from plates 162 and 164.

Of course, if a straw S is particularly badly misshapen it may become lodged in delivery tube 48, at which point the operator can turn off the machine to gain access to the tube as described above and remove the blockage with a minimum of effort.

It will be seen from the foregoing, then, that the straw dispenser described herein is able to dispense a set of straws accurately and at just the right time to the dispensing station of a container-making machine. The dispenser minimizes the chances of a straw becoming lodged in the machine so that it is not dispensed at the proper time. Consequently, the chances of a container being filled and sealed without a straw are minimized. However, in the event that a particular straw is so misshapen that it is unsuitable for use, then the machine will not dispense the straw and it can be removed by the operator with a minimum of time and effort so that production does not suffer. Finally, the dispenser is fast and reliable so that it should prove to be a very useful tool on the production line and one which can be installed and operated at minimum cost.

It will thus be seen that the objects set forth above, among those made apparent from the preceeding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the general and specific features of the invention herein described.

I claim:

1. A straw dispenser comprising
   A. a hopper containing a supply of straws, and
   B. a plurality of indexing stations positioned below and in communication with the hopper, each station including
      1. a rotary index wheel having a plurality of notches distributed about its periphery, each said notch being shaped and arranged to contain a straw, and
      2. a guide plate positioned adjacent the index wheel and extending from a line near the top of the wheel to a line near the bottom thereof so as to trap straws positioned in the wheel notches opposite the guide plate,
   C. means for rotating the index wheels in all of the indexing stations intermittently in unison one notch position to advance the uppermost notches in each wheel toward the upper edge of the corresponding guide plate so that the uppermost notches in each wheel can receive straws from the hopper and are rotated under the associated guide plate while the lowermost notches in each wheel are advanced beyond the lower edge of the corresponding guide plate so that any straws therein are free to fall by gravity,
   D. straw retaining means positioned directly below each indexing station for orienting each straw vertically and engaging the bottom of each straw dropped from the associated indexing station each time the corresponding index wheel is rotated one notch position, and
   E. means for controlling all of the retaining means in unison each time the index wheels are rotated one notch position so as to simultaneously release the set of straws retained therein to a work station as a new set of straws is falling from the index station to the retaining means.

2. The straw dispenser defined in claim 1 wherein each index wheel comprises a rotary cylinder having longitudinal slots distributed around the circumference of the cylinder.

3. The straw dispenser defined in claim 1 wherein each retaining means comprise
   A. a generally vertical delivery tube positioned below the associated indexing station,
   B. a chute extending between the associated index station and the upper end of the corresponding tube, said chute being arranged to conduct straws dropping from that index station into the tube,
   C. a gate positioned at the lower end of the tube for releasably blocking the lower end of the tube, and
   D. wherein the controlling means comprise means for momentarily opening the gates in all of the retaining means in unison.

4. The straw dispenser defined in claim 3 and further including means for shifting all of said chutes horizontally relative to all of said chutes so as to expose the upper ends of the tubes.

5. The straw dispenser defined in claim 1 and further including straw removal means positioned in each indexing station adjacent the lower edge of the indexing wheel at that station, said removal means being shaped and arranged to engage straws advancing toward the removal means when the indexing wheel is rotated that fail to fall out of the lowermost wheel notches when those notches are advanced beyond the lower edge of the associated guide plate.

6. The straw dispenser defined in claim 1 wherein the hopper includes a window through which the quantity of straws in the hopper is visible.

7. A straw dispenser comprising
   A. a base having a pair of tracks thereon,
   B. a hopper for containing a supply of straws,
   C. means for supporting the hopper on the tracks so that the hopper is shiftable along the tracks,
   D. a plurality of indexing sections suspended from the hopper and in communication therewith, each inexing section having
      1. a rotary indexing cylinder, said cylinder having a plurality of longitudinal slots distributed around its circumference, each said slot being shaped and arranged to receive a straw from the hopper, and
      2. guide means positioned adjacent the cylinder in each indexing section, said guide means extending from a line adjacent the upper edge of each cylinder to a line adjacent the lower edge thereof so that when the uppermost slots on the cylinder are advanced toward and under the upper edge of the guide means, any straws therein are trapped in the slots until those slots in the drum are advanced beyond the lower edge of the guide means,
   E. means for intermittently indexing the drums at all of the stations in unison so that each time the drums are indexed, a first set of straws is taken in by slots at the tops of the drums while a second set of straws is released from the slots at the bottoms of the drums, and
   F. means for conducting the set of released straws in unison to a work station.

8. The straw dispenser defined in claim 7 wherein the conducting means comprise
   A. a chute positioned below each indexing station,
   B. a generally vertical delivery tube positioned at the lower end of each chute, and
   C. a gate assembly positioned at the bottoms of the delivery tubes, said gate assembly including
      1. a gate which closes the lower end of each tube, and
      2. means for momentarily opening all of the gates simultaneously each time the indexing wheels are indexed so that the set of straws retained in the delivery tubes are free to drop into a work station as a second set of straws is released by the indexing sections and slides down the chutes into the delivery tubes where they are retained by the gate assembly.

9. The straw dispenser defined in claim 8 wherein
   A. the chutes are suspended from the indexing sections, and
   B. means for supporting the delivery tubes and gate assembly so that when the guide means are shifted relative to the hopper, the tops of the delivery tubes are exposed.

10. The straw dispenser defined in claim 8 and further including straw removal means positioned in each indexing station adjacent the lower edge of the associated drum, said straw removal means being shaped and arranged to wedge straws from the lowermost slots in the associated drum in the event those straws do not fall out of the slots when those slots are advanced beyond the lower edge of the associated guide plate.

11. The straw dispenser defined in claim 7 wherein the indexing means comprise

A. a gear motor,

B. a first clutch connected between the gear motor and the indexing cylinders, and C. means for actuating the clutch intermittently.

12. The straw dispenser defined in claim 11 and further including a manually operable override clutch connected between the first clutch and the cylinders so that the gear motor can continue turning in the event that one or another of the cylinders become jammed.

* * * * *